United States Patent [19]

Kohl et al.

[11] Patent Number: 4,860,644

[45] Date of Patent: Aug. 29, 1989

[54] ARTICULATABLE FUME EXHAUSTER TRUNK

[75] Inventors: James W. Kohl, Eagan; Mark D. Belcher, Burnsville, both of Minn.

[73] Assignee: Donaldson Company, Inc., Minneapolis, Minn.

[21] Appl. No.: 162,175

[22] Filed: Feb. 29, 1988

[51] Int. Cl.[4] ..... B08B 15/00

[52] U.S. Cl. ..... 98/115.4; 285/184; 285/226

[58] Field of Search ..... 98/115.4; 285/163, 164, 285/168, 181, 226, 235, 184

[56] References Cited

U.S. PATENT DOCUMENTS

| | | | |
|---|---|---|---|
| D. 285,832 | 9/1986 | Nederman | D 23/139 |
| 3,818,817 | 6/1974 | Nederman | 98/115.4 |
| 4,259,897 | 4/1981 | Nederman | 98/115.4 |
| 4,540,202 | 9/1985 | Amphoux et al. | 98/115.4 X |

FOREIGN PATENT DOCUMENTS

| | | | |
|---|---|---|---|
| 2525930 | 11/1983 | Fed. Rep. of Germany | 98/115.4 |
| 8304965 | 9/1983 | Sweden . | |
| 2046858 | 11/1979 | United Kingdom | 285/184 |

OTHER PUBLICATIONS

Nederman—Spare Part Drawing of Fume Extractor, Ser. 535, No. 141 497, 1985-01.

Nederman—Technical Description of Fume Extractor, Ser. 535, No. 32 12, 1985-05-01.

Nederman—Installation Examples of Nederman Fume Extractors, No. 32-15.

Nederman—"A New Generation of Fume Extractors for Extraction at Source", No. 32-13.

Nederman—"Nederman's New Fume Extractor Combats Air Pollution at Source", No. 32-13.

Nederman—"The Fume Extractor. The Flexible Source Extractor. With or Without Light.".

Nederman—Mounting Instruction for Fume Extractor 1.5 m.

Nederman—Mounting Instruction for Fume Extractor 2 m.

Nederman—Mounting Instruction for Fume Extractor 4 m V.

Nederman—Mounting Instruction for Fume Extractor 4 m H.

Nederman—"Effectivity and Economy with the Metalmac Pivoting Arm".

Nederman—"Welding Workplace Module".

Nederman—Electrostatic Filter—No. 42-1.

Nederman—Technical Description Electrostatic Filter, Ser. 662.

Nederman—Mini Extractor—No. 32-10.

Nederman—Technical Description—Mini Extractor.

Trunkline—Porta-Trunk (PT-1000 Portable Source Collector

Fume Exhausters Swing-Arc Models 105 and 106.

*Primary Examiner*—Harold Joyce

*Attorney, Agent, or Firm*—Merchant, Gould, Smith, Edell, Welter & Schmidt

[57] ABSTRACT

Fumes are drawn by a vacuum source from a scoop through conduit. The conduit provides its own structure with rigid tubes and which are held with respect to one another, a mounting collar and the scoop by joint attaching assemblies and. In this way, the fume exhauster requires minimal structure. Also, joint assemblies minimize flow resistance since they are located along inside conduit curvatures.

5 Claims, 4 Drawing Sheets

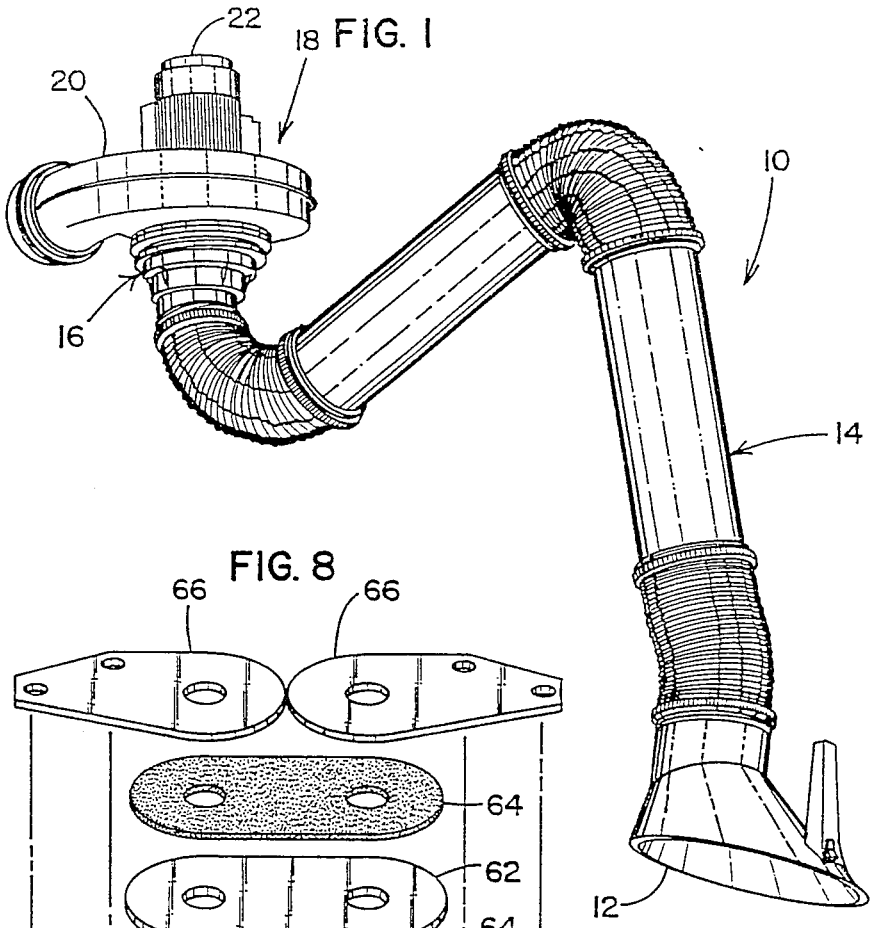
FIG. 1
FIG. 8
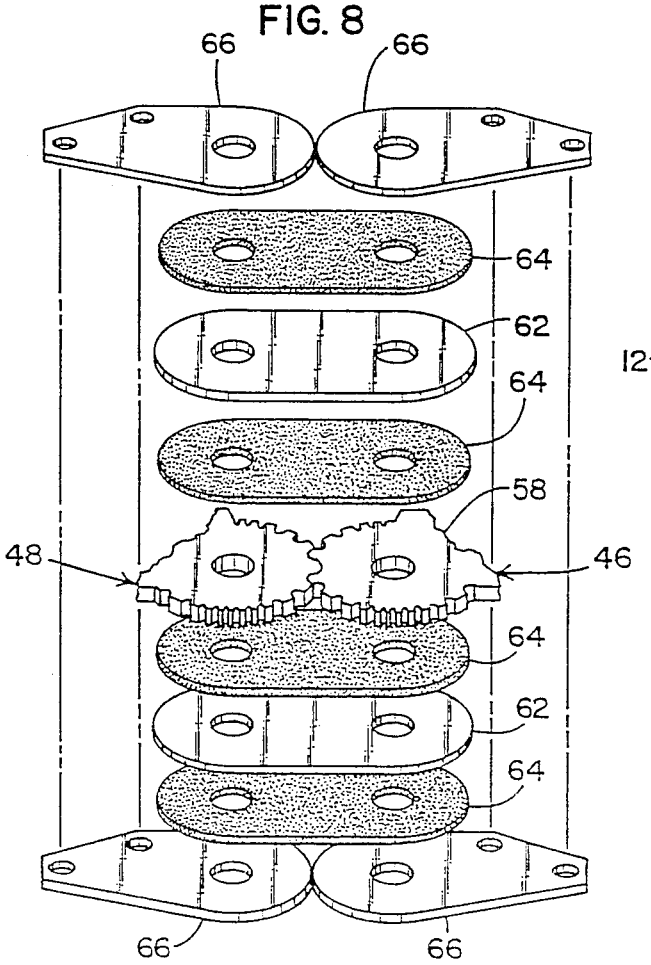

FIG. 4
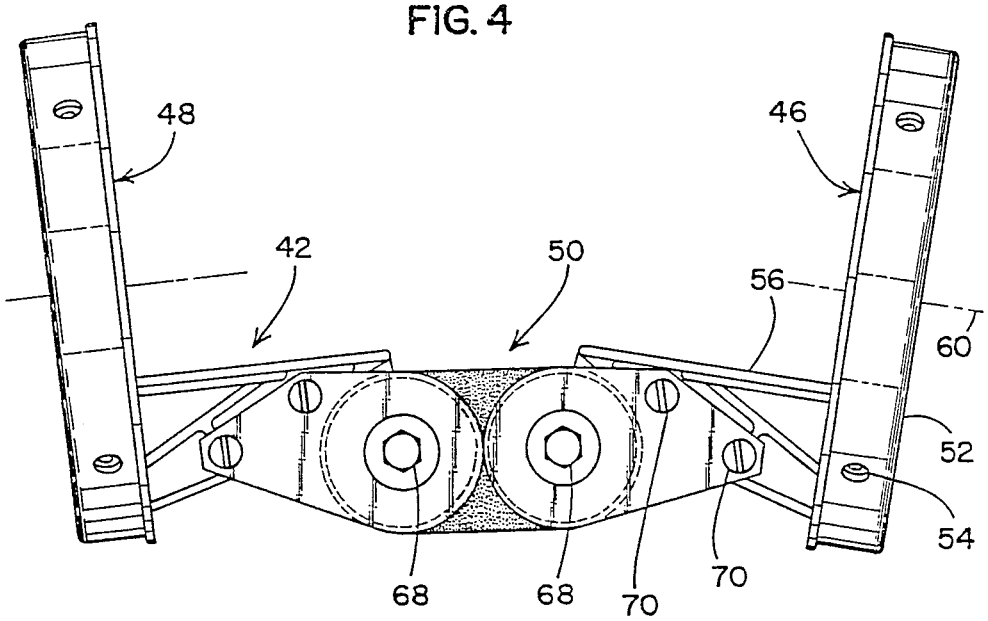
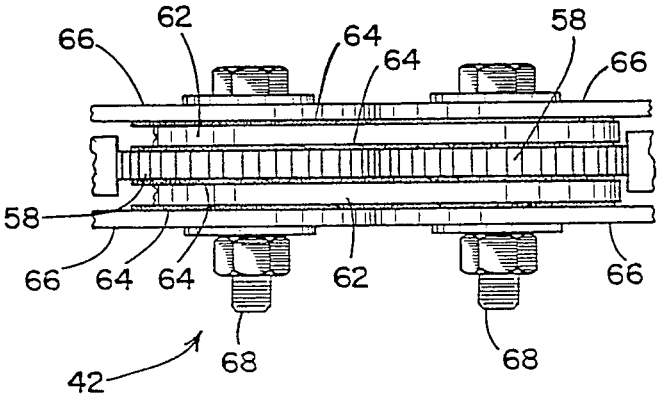
FIG. 5

FIG. 6
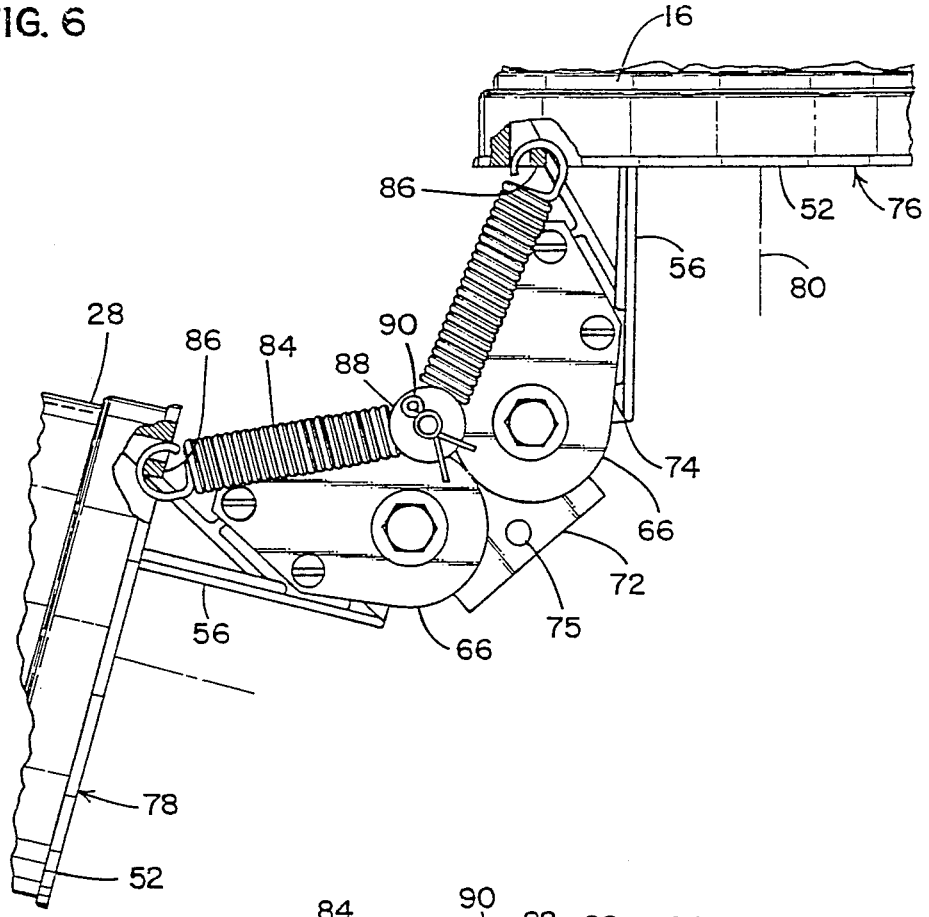
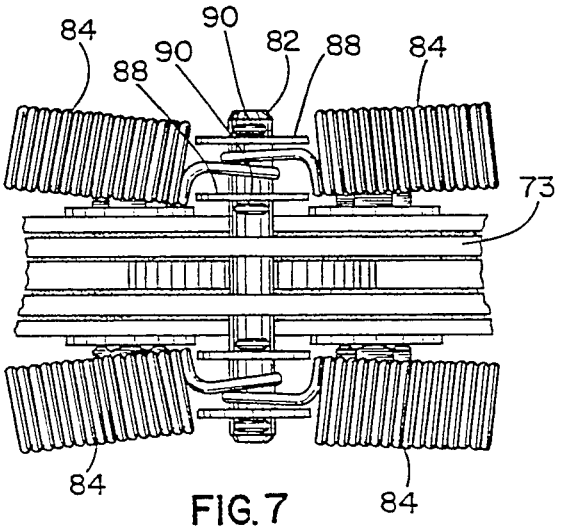
FIG. 7

ARTICULATABLE FUME EXHAUSTER TRUNK

FIELD OF THE INVENTION

The present invention is directed to gaseous exhausting devices and, more particularly, to adjustable arms which direct fumes from an inlet scoop to a vacuum source. The invention is particularly useful for removing fumes from welding operations or other specific sources which may require the inlet scoop to be moved periodically.

BACKGROUND OF THE INVENTION

A few years ago, it was common to use large hoods and provide a suction so that gases arising in an area beneath them would be drawn to them and exhausted through appropriate ducting. Alternatively, the room in which fumes from welding or some other air polluting operation originated was well ventilated. These approaches to the problem required the movement of large volumes of air.

Source removal of fumes is much more efficient. The present invention is directed to a source exhauster. In this regard, it is noted that other source exhausters are known. U.S. Pat. No. 3,818,817 shows an adjustable assembly having lever arms about which there is draped flexible tubing which extends from a suction casing attached to a fan. The problem with this system is that the structural assembly is located within the fluid communication tubing and, consequently, makes fluid flow difficult and requires substantial suction.

A system is also known which provides adjustable supporting mechanism on the outside of flexible tubing. Such system eliminates the fluid flow problem, but is rather unsightly and requires adequate space in which to locate the external superstructure.

A further fume extractor is shown in design U.S. Pat. No. 285,832. Apparently, each arm segment is rigid and attached to the next at a hollow axle portion. Although there is not internal structure, fumes must make two right angle turns at each axle portion. Consequently, fluid flow is still subject to substantial resistance.

The present invention eliminates external structure and locates internal structure in regions of relatively low flow.

SUMMARY OF THE INVENTION

The present invention is directed to fume exhauster apparatus which is in fluid communication with a vacuum source. The apparatus has an unattached end and an end attached to a supporting structure. The apparatus includes a fume receiving scoop, a collar member attached to the supporting structure, and mechanism for directing fluid communication between the scoop and the collar member. The directing mechanism includes first and second rigid tubes having first and second axes, respectively. The directing mechanism further includes a flexible tube fastened between the first and second rigid tubes. The fume exhauster apparatus further includes mechanism for attaching the directing mechanism to the collar member and mechanism for attaching the directing mechanism to the scoop, as well as mechanism located inside the flexible tube for attaching the first and second rigid tubes together. This latter attaching mechanism includes further mechanism for inclining one of the first and second rigid tubes with respect to the other so that the first and second axes remain in a plane regardless of how the rigid tubes are inclined with respect to one another.

The present fume exhauster apparatus is particularly advantageous since the attaching mechanism between the first and second rigid tubes includes mechanism for holding the inclining mechanism adjacent to the inside curvature of the flexible tube. In this way, since the predominant fluid flow is along the outside curvature, the inclining mechanism adjacent to the inside curvature has minimal effect with respect to creating turbulence and flow resistance. At the same time, the rigid tubes and the inclining mechanism provide necessary structure and maneuverability for the exhauster apparatus.

Having been thusly summarized, a preferred embodiment and the advantages of the invention are further explained and may be better understood by reference to the drawings which are briefly described hereinafter and the detailed descriptive matter then following.

BRIEF DESCRIPTION OF THE DRAWINGS

FIG. 1 is a perspective view of fume exhauster apparatus in accordance with the present invention;

FIG. 4 is a side view of mechanism for inclining one tube with respect to another;

FIG. 5 is a bottom view of the mechanism of FIG. 4;

FIG. 6 is a side view of mechanism for inclining a tube with respect to the mounting collar assembly;

FIG. 7 is a view generally from the top of the mechanism of FIG. 6; and

FIG. 8 is an exploded view of inclining mechanism in accordance with the present invention.

DETAILED DESCRIPTION OF THE PREFERRED EMBODIMENT

Figure 2:
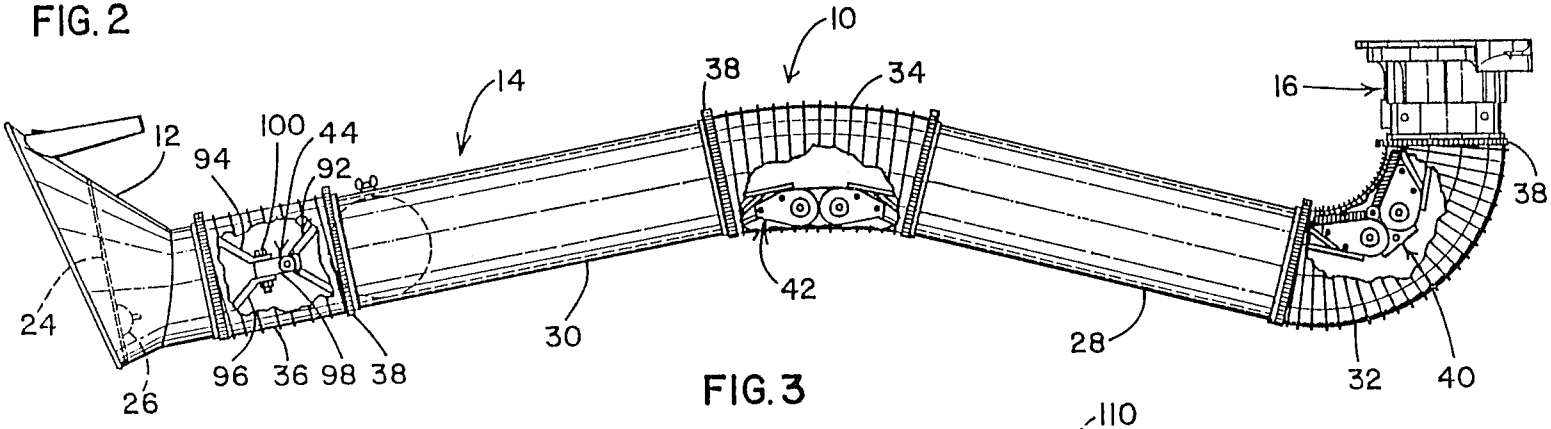
FIG. 2 is a perspective view with portions cutaway.

Referring now to the drawings wherein like reference numerals designate identical or corresponding parts throughout the several views, and more particularly to FIG. 1, fume exhauster apparatus in accordance with the present invention is designated generally by the numeral 10. Apparatus 10 is shown to include a fume receiving scoop 12 attached to one end of fluid directing conduit 14. The other end of conduit 14 is attached to a collar assembly 16 which is attached to a vacuum source 18. Vacuum source 18 is shown to be a fan 20 powered by a motor 22.

As shown in FIG. 2, scoop 12 has a rather large inlet which narrows to a shape which conforms with cylindrical conduit 14. Scoop 12 may include a grill 24 for preventing paper or other large, light objects from being drawn into the system. A light 26 may be mounted to grill 24 to help illuminate the user's work project.

Conduit 14 includes a plurality of rigid tubes and flexible tubes. In particular, there are first and second rigid tubes 28 and 30 made preferably from a polyvinylchloride (PVC) material. Also, there are first, second and third flexible tubes 32, 34 and 36. The flexible tubes are fastened to collar assembly 16, first and second rigid tubes 28 and 30, and scoop 12, with strap-like clamps 38. The structure of conduit 14 is maintained by the rigid tubes and a joint attaching assembly 40 between collar assembly 16 and first rigid tube 28, joint attaching assembly 42 between first and second rigid tubes 28 and 30, and U-joint attaching assembly 44 between second rigid tube 30 and scoop 12.

Joint attaching assembly 42 is shown in more detail in FIGS. 4–5 and 8. Assembly 42 includes a first bracket 46 for attaching to first rigid tube 28 and a second bracket 48 for attaching to second rigid tube 30. Mechanism 50 which allows one of first and second rigid tubes 28 and 30 to incline with respect to other includes portions of and extends between first and second brackets 46 and 48.

First and second brackets 46 and 48 are the same. Bracket 46, for example, includes a cylindrical collar 52 with a plurality of threaded openings 54 spaced circumferentially thereabout. Collar 52 fits over an end of first rigid tube 28, and set screws (not shown) are tightened against first tube 28 to hold bracket 46 thereto. A frame 56 extends outwardly from a portion of collar 52 and includes cantilevered at its end a fixed gear 58. Frame 56 and gear 58 are located within and near the side of an imaginary cylindrical envelope extending from collar 52 and having the same axis 60 as collar 52. As shown in FIG. 8, gears 58 of brackets 46 and 48 are held together by tie members 62 on either side of gears 58. A friction pad 64 is fastened between each tie member 62 and gears 58. Pads 64 aid in holding a relative relationship between gears 58 and, consequently, first and second tubes 28 and 30 in spite of second tube 30 being cantilevered with respect to first tube 28. Support plates 66 help to prevent any bending of inclining mechanism 50 with respect to the plane in which gears 58 are located. Support members 66 are located on each side of gears 58 outwardly from tie members 62. Friction pads 64 are also installed between each set of support members 66 and a tie member 62. Each support member 66 has a shape similar to a gear 58, but does not have gear teeth. A nut and bolt combination 68 provides an axis of rotation for each gear 58 and holds together all of a gear 58, tie members 62, support members 66, and friction pads 64 in the configuration described hereinbefore. In addition, each support member 66 is attached to frame 56 with a pair of screws 70. In operation, as second tube 30 is inclined with respect to first tube 28, the gear portions 58 of brackets 46 and 48 move along one another. Tie members 62 hold gears 58 together. Friction pads 64 give resistance to the movement and provide sufficient resistance to allow relative movement to stop if external force, other than gravity, is removed.

Joint attaching assembly 40 is similar to joint attaching assembly 42, except in two particulars as follows. Tie members 62 have a central rectangular portion with a segment 72 extending in the direction of the axes of collar assembly 16 and first tube 28 and a segment 73 extending in the other direction. Both segments 72 and 73 have openings 75 transversely centered on tie members 62 and located near an edge. Segments 72 function as stops by contacting end portions 74 of frames 56 which are a part of third and fourth brackets 76 and 78 attached to collar assembly 16 and first tube 28 respectively. In this way, first tube 28 can be inclined from the axis 80 of collar assembly 16 in one direction, but not the other.

The other way in which joint attaching assembly 40 differs from joint attaching assembly 42 is that it includes a biasing mechanism which encourages an inclining of first tube 28 with respect to axis 80 of collar assembly 16. In particular, a pin 82 extends through openings 75 in segments 73. Four springs 84 are attached in extension in substantial alignment with support members 66. Two springs 84 are attached to extend in generally opposite directions from one end of pin 82 and two springs 84 are attached in a similar fashion from the other end. The other ends of springs 84 attach to an appropriate portion 86 of frame 56 near the appropriate collar 52 of bracket 76 or 78. A washer 88 and cotter key 90 on either side of springs 84 prevent the ends of springs 84 from slipping off pin 82 or into interference with other components.

Joint attaching assembly 44 includes brackets 92 and 94 fastened to second tube 30 and scoop 12, respectively, in the same fashion as bracket 46, for example, is fastened to first tube 28. Each bracket 92 and 94 includes arms 96 extending away from second tube 30 or scoop 12, but toward the axis of each. Each set of arms 96 come together on opposite sides of universal joint member 98. Each set of arms 96 is attached to member 98 with a nut and bolt combination 100 such that the axis provided by the respective bolt is oriented 90 degrees with respect to the other bolt. In this way, a universal joint is formed so as to have orthogonal axes which are also perpendicular to the axes of second tube 30 and scoop 12 when the axes are aligned.

Figure 3:
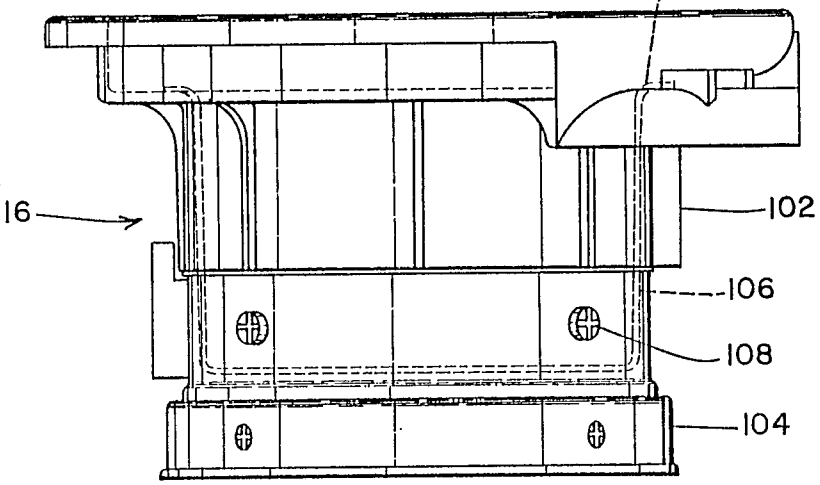
FIG. 3 is side view of a mounting collar assembly.

As shown in FIG. 3, collar assembly 16 includes a mount collar 102 which is fixedly attached to a supporting structure, commonly fan 20 as shown in FIG. 1. It is understood, of course, that fan 20 must be mounted to a ceiling, wall, or some other fixed or portable structure. Collar assembly 16 also includes an adapter collar 104 having an end 106 which fastens to first tube 28 in the fashion described previously with respect to bracket 46. An intermediate insert member 106 extends between mount collar 102 and adapter collar 104. Adapter collar 104 is fixedly attached to insert member 106 with a plurality of set screws 108 spaced circumferentially about cylindrically shaped adapter collar 104. The other end 110 of insert member 106 is flared outwardly to rest against a transverse portion of mount collar 102. A lubricating grease (not shown) is spread between the facing surfaces of mount collar 102 and insert member 106. In use, conduit 14 may be rotated about mount collar 102 as insert member 106 is free to slidably rotate with respect to mount collar 102. Generally, the axis of collar assembly 16 is vertical, although not necessarily so. Joint attaching assembly 40 is biased to incline first rigid tube 28 toward the horizontal, or at least toward a direction perpendicular to the axis of collar assembly 16. Segments 72 function as stops and prevent rigid tube 28 from inclining too far in an opposite direction. Springs 84 bias rigid tube 28 to incline in the indicated direction and aid in supporting first rigid tube 28 in an inclined orientation.

Joint attaching assembly 42 is preferably located so that its gears are in the same plane as the gears of joint attaching assembly 40. The preferred direction of inclination, however, is 180 degrees with respect to joint attaching assembly 40.

Joint attaching assembly 44 provides universal joint type movement for scoop 12 so that scoop 12 may be locally oriented and in light 26 appropriately directed.

Fume exhauster apparatus 10 is particularly advantageous since it does not require long internal lever arms or external superstructure, rather the structure of apparatus 10 is supplied by the rigid tubing and the joint assemblies between the rigid tubing and the end members of the structure. Furthermore, since joint assemblies 40 and 42 are oriented so that the gears all lie in the same plane, additional support members can be provided to minimize the likelihood of inadvertent bending in a direction in which the structure is not intended to bend. The general direction for locating conduit 14 is obtained by rotational movement in collar assembly 16. Appropriate distance between scoop 12 and collar assembly 16 is achieved by inclinations made a joint attaching assemblies 40 and 42. Any final adjustment of scoop 12 with light 26 therein is made with universal joint assembly 44.

In addition to minimal structure, it is noted that joint assemblies 40 and 42 are locatable away from the predominate fluid flow as the gaseous fume fluids are directed by the appropriate curved flexible tubes. In particular, both joint assemblies 40 and 42 are located along inside curvatures which are generally away from the predominate fluid flow path along outside curvatures.

With the preferred embodiments thusly described, it is pointed out that it is understood numerous equivalents may be possible. Consequently, in conclusion, it is noted that any changes made from the disclosure, especially in matters of shape, size, and arrangement of parts to the full extent extended by the general meaning of the terms in which the appended claims are expressed, are within the principle of the invention.

What is claimed is:

1. A flume exhauster apparatus adapted for fluid communication with a vacuum source, the apparatus having an end attached to a supporting structure, the apparatus comprising:

a fume receiving scoop;

a collar member adapted for attachment to the supporting structure;

means for directing fluid communication between said scoop and said collar member, said directing means including first and second rigid tubes having first and second axes, respectively, said directing means further including a flexible tube fastened between said first and second rigid tubes;

first means for attaching said directing means to said collar member;

second means, located inside said flexible tube, for attaching said first and second rigid tubes together, said second attaching means including first means for inclining one of said first and second rigid tubes with respect to the other so that said first and second axes remain in a plane, said first inclining means including first and second brackets with first and second gear portions, respectively, said first inclining means further including means for operably holding said first and second gear portions in contact with one another; and third means for attaching said directing means to said scoop.

2. Apparatus in accordance with claim 1 wherein said collar member has a third axis and wherein said first attaching means includes second means for inclining said directing means with respect to said collar member so that the first and third axes remain in a plane.

3. Apparatus in accordance with claim 1 wherein said holding means includes tie members with respect to said first and second gear portions, said holding means further including a friction pad between each one of said tie members and said first and second gear portions.

4. Apparatus in accordance with claim 3 wherein said first and second gear portions are located in said plane and wherein said holding means further includes means for supporting said gear portions from bending with respect to said plane

5. Fume exhauster apparatus in fluid communication with a vacuum source, said apparatus having an end attached to a supporting structure, said apparatus comprising:

first and second rigid tubes having first and second axes, respectively;

a fume receiving scoop forming an unattached end;

a collar member attached to said supporting structure, said collar member having a third axis;

first, second, and third flexible tubes, said first flexible tube providing fluid communication between said collar member and said first rigid tube, said second flexible tube providing fluid communication between said first and second rigid tubes, said third flexible tube providing fluid communication between said second rigid tube and said scoop;

first means for attaching said first rigid tube to said collar member, said first attaching means including first means for inclining said first rigid tube in one direction with respect to the third axis to define first inside and outside curvatures for said first flexible tube, said first inclining means including first and second brackets with first and second gear portions, respectively, said first and second gear portions being located in a first common plane, said first inclining means further including first means for operably holding said first and second gear portions in contact with one another, said first holding means including first tie members with respect to said first and second gear portions, said first holding means further including a first friction pad between each one of said first tie members and said first and second gear portions, said first inclining means also including first means for supporting said first and second gear portions from bending with respect to said first plane, said attaching means further including means for biasing inclination of said first tube in one direction with respect to said third axis, said first attaching means still further including means for stopping said first tube so that said first axis does not incline in a second direction with respect to said third axis;

second means for attaching said first tube to said second tube, said second attaching means including second means for inclining said second tube with respect to the first axis of said first tube to define second inside and outside curvatures for said second flexible tube, said second inclining means including third and fourth brackets with third and fourth gear portions, respectively, said third and fourth gear portions being located in a second common plane, said second inclining means further including second means for operably holding said third and fourth gear portions in contact with one another, said second holding means including second tie members with respect with to said third and fourth gear portions, said second holding means further including a second friction pad between each one of said second tie members and said first and second gear portions, said second inclining means also including second means for supporting said first and second gear portions from bending with respect to said second plane; and third means for attaching said second rigid tube to said scoop.

* * * * *